US006708451B1

(12) United States Patent
Gomes

(10) Patent No.: US 6,708,451 B1
(45) Date of Patent: Mar. 23, 2004

(54) INFLATABLE TENT

(76) Inventor: Keola Richard Gomes, 31 Kuhinia St., Wailuku, HI (US) 96793

( * ) Notice: Subject to any disclaimer, the term of this patent is extended or adjusted under 35 U.S.C. 154(b) by 71 days.

(21) Appl. No.: 10/080,439

(22) Filed: Feb. 22, 2002

(51) Int. Cl.[7] ..... E04H 15/20

(52) U.S. Cl. ..... 52/2.17; 52/2.18; 52/2.25; 52/2.22; 135/87

(58) Field of Search ..... 52/2.11, 2.17, 52/2.18, 2.19, 2.22, 2.24, 2.25; 135/87

(56) References Cited

U.S. PATENT DOCUMENTS

| | | | | |
|---|---|---|---|---|
| 3,840,919 | A | * | 10/1974 | Middleton |
| 4,332,112 | A | * | 6/1982 | Hsu |
| 4,556,391 | A | * | 12/1985 | Tardivel et al. |
| 4,819,389 | A | * | 4/1989 | Kihn |
| 4,876,829 | A | * | 10/1989 | Mattick |
| 4,901,481 | A | * | 2/1990 | Seeley |
| 5,007,212 | A | * | 4/1991 | Fritts et al. ..... 52/2.18 |
| 5,247,768 | A | * | 9/1993 | Russo ..... 52/2.22 X |
| D371,252 | S | * | 7/1996 | Chaput ..... D6/381 |
| D378,169 | S | * | 2/1997 | Yu ..... D6/334 |
| 5,642,750 | A | * | 7/1997 | Brown et al. ..... 135/137 |
| D407,230 | S | * | 3/1999 | Lieberman ..... D6/381 |
| 5,913,322 | A | * | 6/1999 | Gallant et al. ..... 135/137 |
| 5,951,111 | A | * | 9/1999 | Klimenko ..... 297/452.41 |
| 6,019,112 | A | * | 2/2000 | Matlock ..... 135/124 |
| 6,167,898 | B1 | * | 1/2001 | Larga et al. |
| 6,206,475 | B1 | * | 3/2001 | Tai ..... 297/452.41 |

FOREIGN PATENT DOCUMENTS

| | | | | |
|---|---|---|---|---|
| EP | 0 359 691 | * | 3/1990 | ..... E04H/15/20 |

* cited by examiner

*Primary Examiner*—Robert Canfield

(57) ABSTRACT

In the present invention an inflatable tent comprising a pliable base is connected to a pliable shell. An inflatable support rib is connected to the pliable shell, and a support frame is connected to the pliable shell.

2 Claims, 4 Drawing Sheets

INFLATABLE TENT

BACKGROUND OF THE INVENTION

1. Field of the Invention

The present invention relates to an inflatable tent for use in connection with tents. The inflatable tent has particular utility in connection with an inflatable tent with an integral air mattress.

2. Description of the Prior Art

Inflatable tents are desirable for quickly forming the shell of a tent. A common difficulty in setting up tents is preventing them from falling during construction. Inflatable tents take shape upon filling the structural airframe with pressurized air and allow the support frame to be easily inset due to the fact that the tent is self-supporting.

The use of tents is known in the prior art. For example, U.S. Pat. No. 6,167,898 to Larga et al discloses tent with integral air mattress that includes a base member composed of a bottom water resistant layer and at least one inflatable air mattress attached to the top of the bottom layer. A support frame extends upward from the base member and supports a fabric shell so as to define a tent interior. However, the Larga et al '898 patent does not have inflatable rib air passageways attached to the cover to support the tent while the support frame is being assembled.

Similarly, U.S. Pat. No. 5,642,750 to Brown et al discloses a tent having a continuous seamless peripheral surface and containing an integral self-inflating floor that has a spherical tent and an attached air mattress that self-inflates. However, the Brown et al '750 patent does not have inflatable rib air passageways attached to the cover to support the tent while the support frame is being assembled.

U.S. Pat. No. 4,531,330 to Phillips discloses a bed/shelter unit that comprises a panel of flexible tent material adapted to arch over the inflatable mattress from one side to the other. The panel has inflatable arches at its ends that are adapted when inflated to extend over the mattress from one side to the other. End closures at the ends of the tent hold the arches in an erected position with the panel drawn between the arches and the mattress. However, the Phillips '330 patent does not have inflatable rib air passageways attached to the cover to support the tent while the support frame is being assembled.

U.S. Pat. No. 5,660,197 to Boe et al discloses a tent with integrated inflatable mattress that has an outer sidewall supported by a par of flexible support poles. A double cushioned floor aligns with the bottom of the tent and is permanently sealed around the perimeter of the tent. An integral inflatable mattress is formed between the cushioned floor and a mattress upper surface. However, the Boe et al '197 patent does not have inflatable rib air passageways attached to the cover to support the tent while the support frame is being assembled.

Lastly, U.S. Pat. No. 5,502,927 to Hammerton discloses a portable, inflatable tent that has a semi-cylindrical cover portion that fastens to a planar base portion. The cover portion is provided with rib air-passageways that when inflated, support the cover portion in its semi-cylindrical configuration. However, the Hammerton '927 patent does not have inflatable rib air passageways attached to the cover to support the tent while the support frame is being assembled.

While the above-described devices fulfill their respective, particular objectives and requirements, the aforementioned patents do not describe a inflatable tent that allows an inflatable tent with an integral air mattress. The Larga et al '898, Brown et al '750, Phillips '330, Boe et al '197 and Hammerton '927 patents make no provision for inflatable rib air passageways attached to the cover to support the tent while the support frame is being assembled.

Therefore, a need exists for a new and improved inflatable tent that can be used for an inflatable tent with an integral air mattress. In this regard, the present invention substantially fulfills this need. In this respect, the inflatable tent according to the present invention substantially departs from the conventional concepts and designs of the prior art, and in doing so provides an apparatus primarily developed for the purpose of an inflatable tent with an integral air mattress.

SUMMARY OF THE INVENTION

In view of the foregoing disadvantages inherent in the known types of tents now present in the prior art, the present invention provides an improved inflatable tent, and overcomes the above-mentioned disadvantages and drawbacks of the prior art. As such, the general purpose of the present invention, which will be described subsequently in greater detail, is to provide a new and improved inflatable tent and method which has all the advantages of the prior art mentioned heretofore and many novel features that result in a inflatable tent which is not anticipated, rendered obvious, suggested, or even implied by the prior art, either alone or in any combination thereof.

To attain this, the present invention essentially comprises a pliable base connected to a pliable shell. An inflatable support rib is connected to the pliable shell, and a support frame is connected to the pliable shell. An inflatable mattress is connected to the pliable base.

There has thus been outlined, rather broadly, the more important features of the invention in order that the detailed description thereof that follows may be better understood and in order that the present contribution to the art may be better appreciated.

The invention may also include pliable screened windows and window covers, pliable doors and an attachment for an inflatable sofa. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved inflatable tent that has all of the advantages of the prior art tents and none of the disadvantages.

It is another object of the present invention to provide a new and improved inflatable tent that may be easily and efficiently manufactured and marketed.

An even further object of the present invention is to provide a new and improved inflatable tent that has a low cost of manufacture with regard to both materials and labor, and which accordingly is then susceptible of low prices of sale to the consuming public, thereby making such inflatable tent economically available to the buying public.

Still another object of the present invention is to provide a new inflatable tent that provides in the apparatuses and methods of the prior art some of the advantages thereof, while simultaneously overcoming some of the disadvantages normally associated therewith.

Even still another object of the present invention is to provide an inflatable tent for an inflatable tent with an integral air mattress that is quick and convenient to set up.

Yet even still another object of the present invention is to provide an inflatable tent for an inflatable tent with an integral air mattress that is lightweight.

Lastly it is an object of the present invention is to provide an inflatable tent for an inflatable tent with an integral air mattress that is compact.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
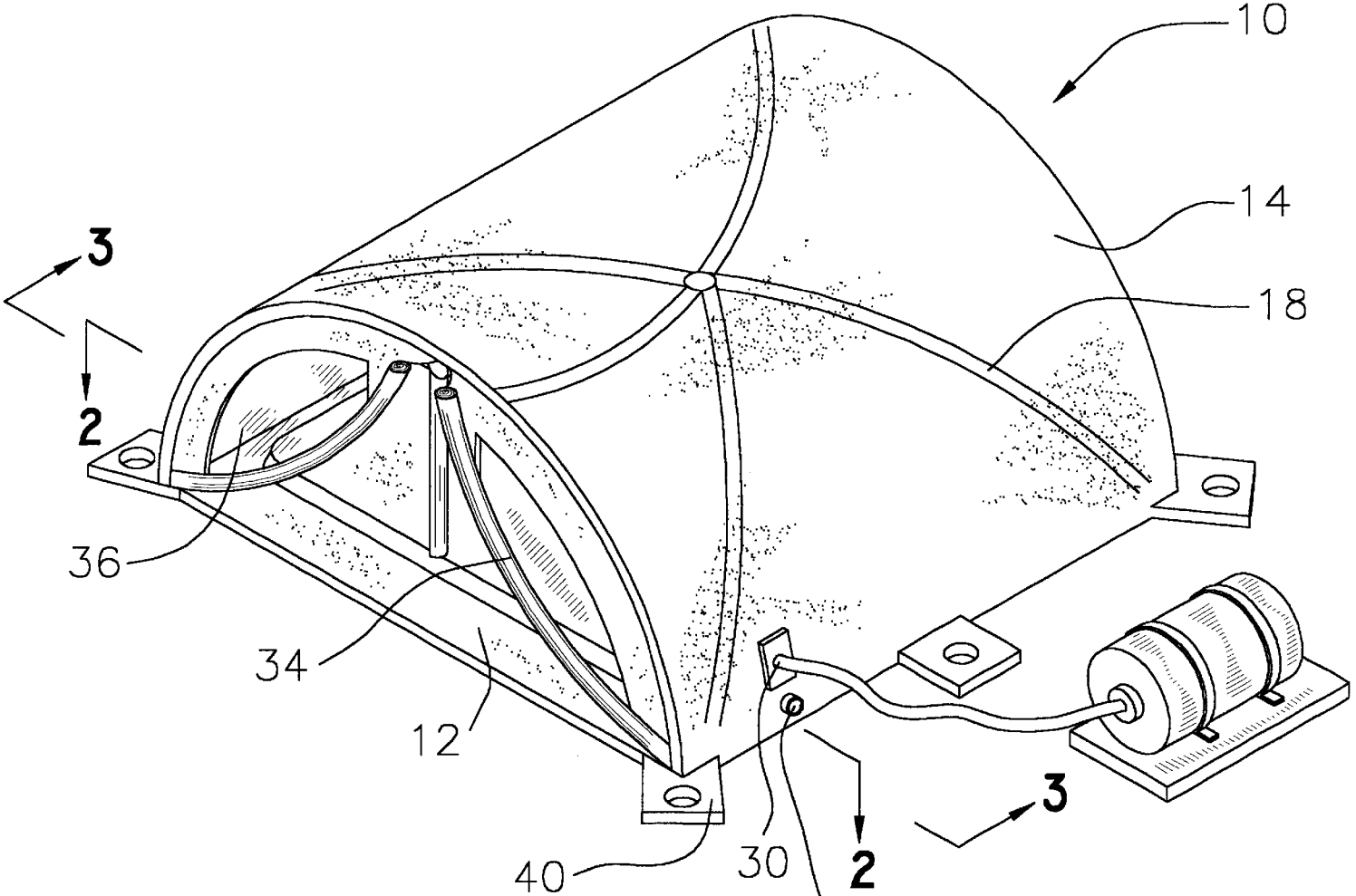
FIG. 1 is a side perspective view of the preferred embodiment of the inflatable tent constructed in accordance with the principles of the present invention.

Referring now to the drawings, and particularly to FIGS. 1–4, a preferred embodiment of the inflatable tent of the present invention is shown and generally designated by the reference numeral 10.

In FIG. 1, a new and improved inflatable tent 10 of the present invention for an inflatable tent with an integral air mattress is illustrated and will be described. More particularly, the inflatable tent 10 has a water-repellent pliable base 12, nylon in the present example. There is a water repellent pliable shell 14, nylon in the present example, connected to the base 12. A pliable door 34 is connected to the shell 14. A pliable screened window 36 is connected to the shell 14. A tent peg attachment member 40 is connected to the base.

Figure 2:
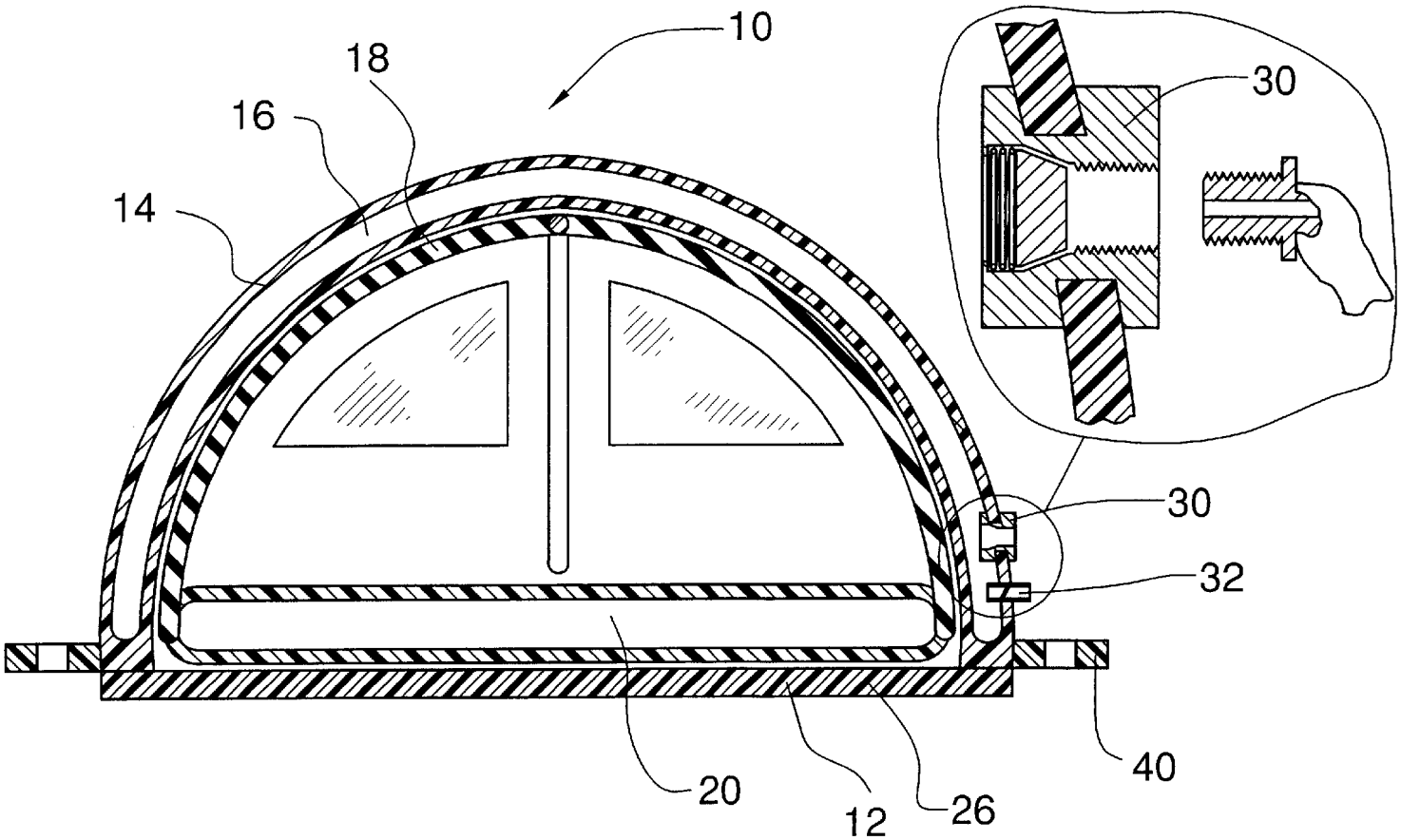
FIG. 2 is a sectional view 2—2 of FIG. 1 of the inflatable tent of the present invention.

In FIG. 2 the cross section view shows the inflatable tent 10 has the base 12 having an attached multi-layer protective lining 26. The shell 14 is connected to the base 12. A support frame 18, fiberglass tubing in the present example, is connected to the shell 14. At least one inflatable mattress 20 is attached to the base 12. At least one inflatable support rib 16, sealed rubberized canvas tubes in the present example, is connected to the shell 14. A rib inflation valve 30 and a rib deflation valve 32 communicates with the inflatable support rib 16. The support frame 18 is connected to the shell 14. The pliable screened window 36 is connected to the shell 14, and a pliable window shade 38 is connected to the screened window 36.

Figure 3:
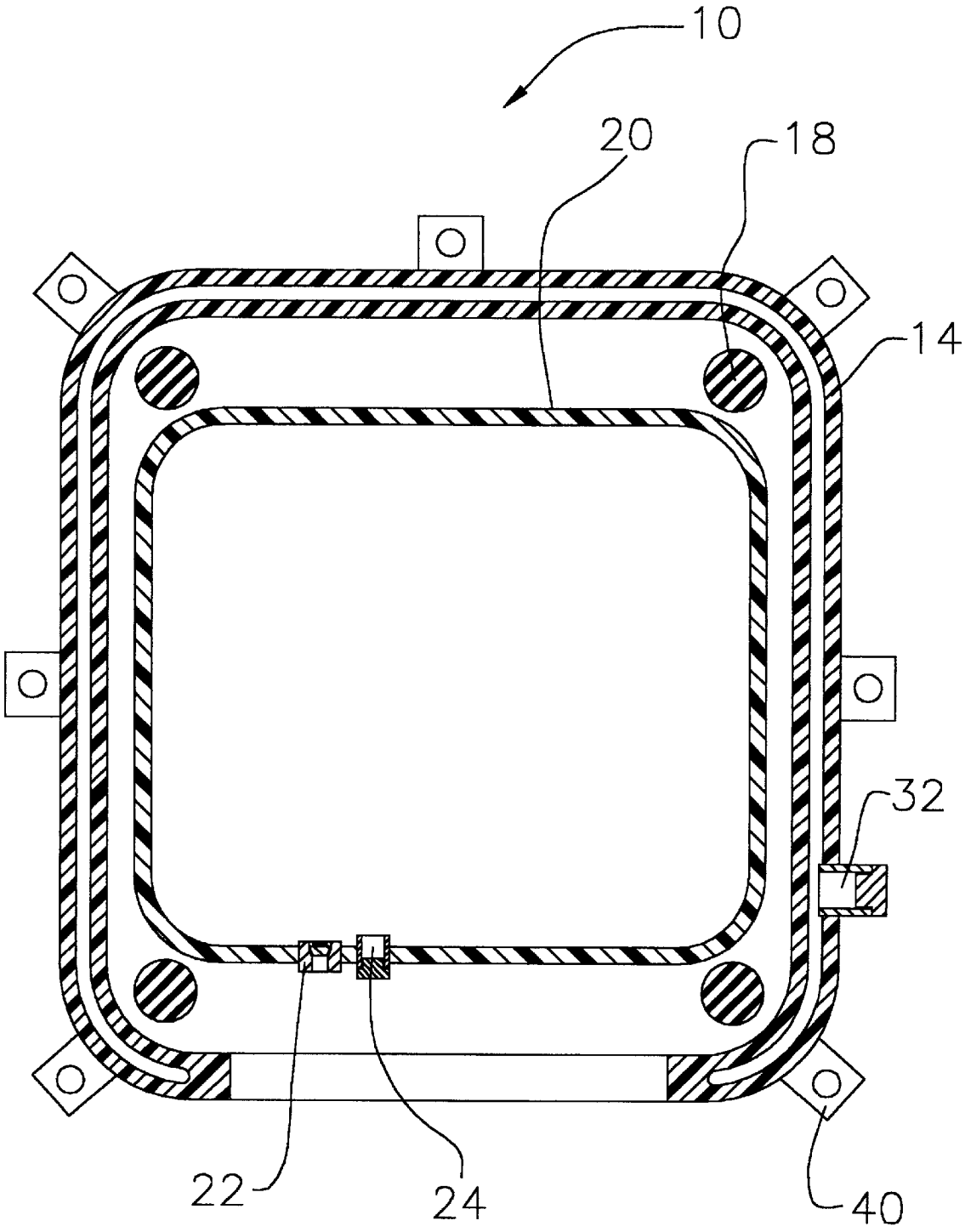
FIG. 3 is a sectional view 3—3 of FIG. 1 of the inflatable tent of the present invention.

In FIG. 3 the cross section view shows the inflatable tent 10 has the base 12. The shell 14 is peripherally connected to the base 12. The inflatable mattress 20 is attached to the base 12. A mattress inflation valve 22 and a mattress deflation valve 24 communicates with the inflatable mattress 20. The rib inflation valve 30 and the rib deflation valve 32 communicates with the inflatable support rib 16. The support frame 18 is connected to the shell 14. The tent peg attachment member 40 is connected to the base. The tent peg attachment member 40 is connected to the base.

Figure 4:
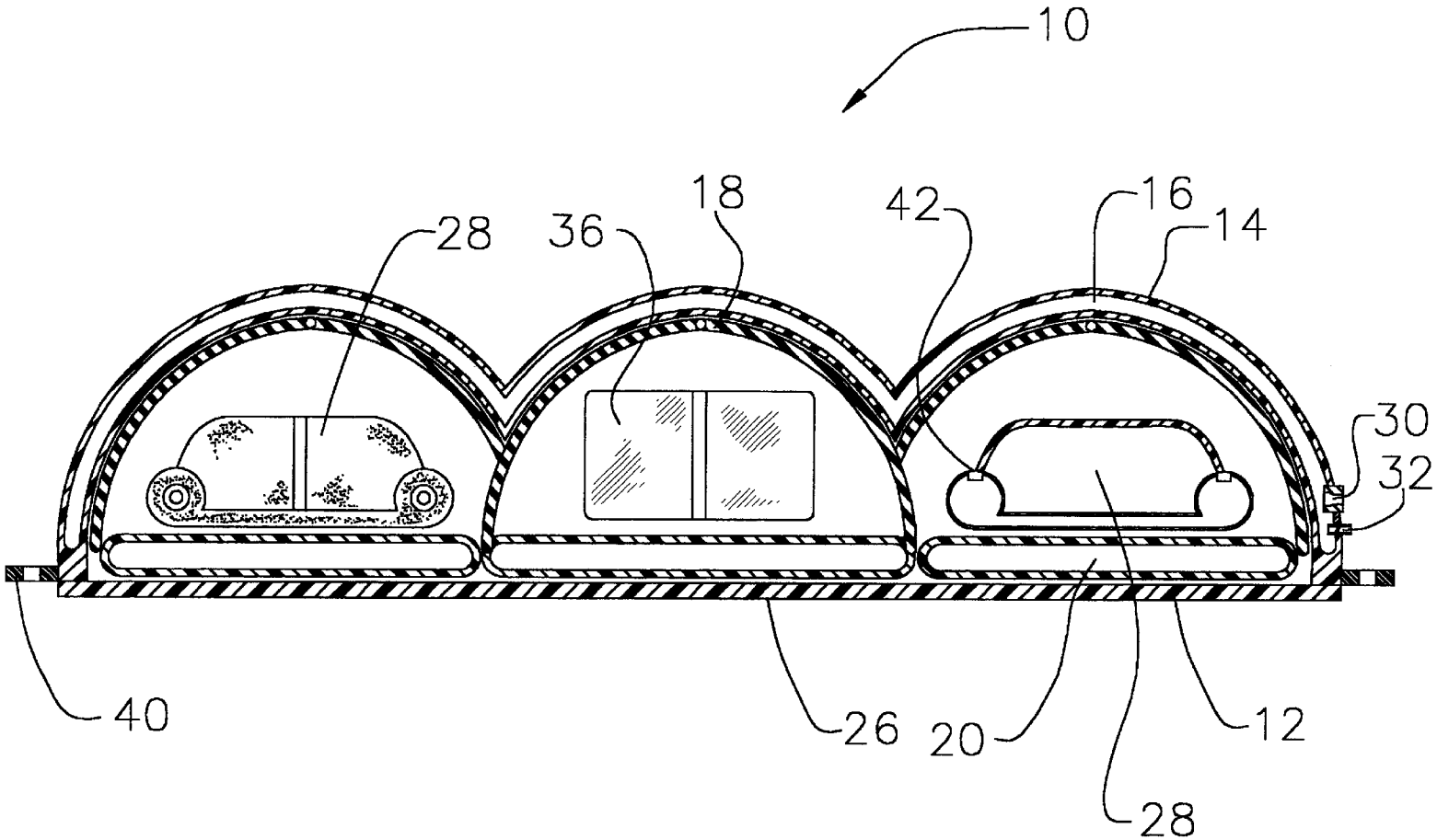
FIG. 4 is a cross sectional view of a second embodiment of the inflatable tent of the present invention.

In FIG. 4 the cross section view of the second embodiment of the invention is shown. The inflatable tent 10 has the base 12 having an attached multi-layer protective lining 26. There is at least one shell 14 peripherally connected to the base 12. The inflatable mattress 20 is attached to the base 12. The inflatable support rib 16 is connected to the shell 14. The rib inflation valve 30 and the rib deflation valve 32 communicates with the inflatable support rib 16. The support frame 18 is connected to the shell 14. A detachable inflatable sofa 28 is connected to the shell 14, the sofa having inset cup holders 42 in the armrests. The tent peg attachment member 40 is connected to the base. The pliable screened window 36 is connected to the shell 14.

In use, it can now be understood that the tent is inflated with the rib inflation valve 30, the support frame 18 is then constructed and the inflatable mattress 20 is inflated.

While a preferred embodiment of the inflatable tent has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable covering material such as rubber may be used instead of the nylon described. Also, the support frame may be made of any rigid material such as plastic, aluminum or carbon reinforced composite instead of the fiberglass described. And although an inflatable tent with an integral air mattress have been described, it should be appreciated that the inflatable tent herein described is also suitable for constructing any temporary portable outside structure.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inflatable tent comprising:

a pliable base;

at least one pliable shell connected to said base;

at least one inflatable mattress attached to said base;

at least one inflatable support rib connected to said shell;

a support frame connected to said shell;

a rib inflation valve communicating with said inflatable support rib;

a rib deflation valve communicating with said inflatable support rib;

a mattress inflation valve communicating with said inflatable mattress;

a mattress deflation valve communicating with said inflatable mattress; and an inflatable sofa connected to said shell.

2. A inflatable tent comprising:

a water repellant pliable base;

at least one water repellant pliable shell peripherally connected to said base;

at least one inflatable mattress attached to said base;

a mattress inflation valve communicating with said inflatable mattress;

a mattress deflation valve communicating with said inflatable mattress;

at least one inflatable support rib connected to said shell;

a rib inflation valve communicating with said inflatable support rib;

a rib deflation valve communicating with said inflatable support rib;

a support frame connected to said shell;

an inflatable sofa connected to said shell, said sofa having arm rests, said sofa having an integral cup holder attached to said arm rest; and a tent peg attachment member connected to said base.

* * * * *